US005536148A

United States Patent [19]

Nishiuchi et al.

[11] Patent Number: 5,536,148

[45] Date of Patent: Jul. 16, 1996

[54] TURBO VACUUM PUMP

[75] Inventors: Akira Nishiuchi, Ibaraki-ken; Masahiro Mase, Tochigi-ken; Noboru Matsumura, Ibaraki-ken; Katsuaki Kikuchi, Tsuchiura; Takashi Nagaoka, Tsukuba; Seiji Sakagami, Ibaraki-ken, all of Japan

[73] Assignee: Hitachi, Ltd., Tokyo, Japan

[21] Appl. No.: 297,017

[22] Filed: Aug. 29, 1994

[30] Foreign Application Priority Data

Sep. 17, 1993 [JP] Japan ..... 5-231260

[51] Int. Cl.[6] ..... F04B 23/14

[52] U.S. Cl. ..... 417/203; 417/205; 417/234; 417/423.4; 417/423.8; 417/423.9; 417/424.2; 415/90; 415/143

[58] Field of Search ..... 417/201, 203, 417/205, 234, 244, 423.4, 423.8, 423.9, 423.12, 423.14, 424.2; 415/90, 143, 198.1, 55.5

[56] References Cited

U.S. PATENT DOCUMENTS

| | | | |
|---|---|---|---|
| 3,478,958 | 11/1969 | Hink, III et al. | 417/234 |
| 4,729,722 | 3/1988 | Toth | 417/234 |
| 4,954,047 | 9/1990 | Oruyama et al. | 415/90 |
| 5,020,969 | 6/1991 | Mase et al. | 415/90 |

FOREIGN PATENT DOCUMENTS

| | | | |
|---|---|---|---|
| 4-77160 | 11/1983 | Japan | F04D 19/04 |
| 3-7039 | 4/1985 | Japan | F04D 19/04 |
| 3085288 | 4/1988 | Japan | 415/90 |
| 2-264196 | 4/1989 | Japan | F04D 19/04 |
| 3-115797 | 2/1990 | Japan | F04D 19/04 |
| 5133386 | 5/1993 | Japan | 417/423.4 |

*Primary Examiner*—Charles Freay

*Attorney, Agent, or Firm*—Antonelli, Terry, Stout & Kraus

[57] ABSTRACT

A turbo vacuum pump for compressing a low-pressure gas to discharge the compressed gas into atmosphere comprises pump stator having a gas flow passage comprising a plurality of annular flow passages on an inner surface thereof arranged stepwise diameters of which become smaller toward downstream and passages intercommunicating with adjacent annular flow passages and a gas discharge port communicated with one of the plurality of annular flow passages disposed at the most downstream. The pump stator includes a cylindrical spiral grooved pump impeller and a plurality of peripheral flow pump impellers facing the annular flow passages provided downstream of the cylindrical spiral grooved pump impeller and having stepwise diameters which become smaller toward downstream to form a peripheral flow pump stage. The suction casing has a spiral groove on a cylindrical inner surface thereof arranged with a predetermined clearance in relation to the spiral grooved pump impeller of the pump rotor so as to form a spiral grooved pump stage and a gas suction port communicated with the spiral grooved pump stage.

13 Claims, 5 Drawing Sheets

TURBO VACUUM PUMP

BACKGROUND OF THE INVENTION

This invention relates to a turbo vacuum pump in which an outlet port pressure and atmospheric pressure are the same and, more particularly, to a vacuum pump suitable for generating a clean vacuum for use in equipments for manufacture of food, pharmaceuticals, and the like.

In a conventional turbo vacuum pump, an axial flow blade having excellent discharge performance in the molecular flow region is often used. The other hand, in recent years, a turbo vacuum pump has been developed which can provide a high compression ratio in the viscous flow region and has peripheral-flow impellers formed in multiple stages. An example of this is described in Japanese Patent Unexamined Publication No. 2-264196. The turbo vacuum pump described therein can discharge air into atmosphere but it has a drawback that disassembly of a pump rotor is not easy since the pump rotor and a pump stator are staggered.

Also, a turbo vacuum pump has been proposed in which pressure level of an outlet port and atmospheric pressure are the same, an example of which is described in Japanese Patent Unexamined Publication No. 3-7039 (corresponding to U.S. Pat. No. 4,668,160). In the turbo vacuum pump, a stator forming an air path protrudes between rotor blades. Therefore, the stator must have structure which is dividable in an axial direction into two halves. As a result, the number of parts of the stator increases. Accordingly, when the stator is assembled, dimensional tolerances of the parts are accumulated and it becomes difficult to control dimentions of thin clearances between the stator and the rotor and to obtain the thin clearances. It is difficult to obtain a desired pump performance.

SUMMARY OF THE INVENTION

It is an object of the invention to provide a turbo vacuum pump which has small number of parts, is compact and easily manufactured, and in which the dimention control of each part is easy.

Also, it is a further object of the invention to provide a turbo vacuum pump in which it is possible to reduce the variation in performance due to manufacturing factors.

In order to accomplish the above objects, provided is a turbo vacuum pump comprising a casing having an air suction port formed therein, a pump stator attached to the casing and having an air discharge port and a cavity formed in an inside thereof, a pump rotor having its outer periphery disposed opposite to an internal peripheral surface of the pump stator, and a rotating shaft having the pump rotor attached to one end thereof and supported for rotation by bearings, wherein a low-pressure gas sucked from the air suction port is compressed and discharged from the air discharge port into the atmosphere. The pump rotor is formed as one unit and has a spiral grooved pump stage formed at an air suction side thereof and a peripheral-flow pump stage formed downstream from the spiral grooved pump stage. The peripheral-flow pump stage has a diameter stepwise decreasing towards downstream. The pump stator has an inner diameter of the portion opposed to the peripheral-flow pump stage of the pump rotor stepwise decreasing towards downstream to form a predetermined clearance therebetween. A cooling jacket through which a coolant circulates is formed on an outer periphery of the pump stator. The casing is disposed opposite to the pump rotor so as to form a predetermined clearance between the spiral grooved pump stage of the pump rotor. A motor rotor for driving the pump rotor is attached to the other side of the rotating shaft opposite to the side thereof to which the pump rotor is attached. A motor stator is disposed opposite to the motor rotor. A motor casing holding the motor stator and having on an outer periphery thereof a cooling passage through which a coolant circulates is attached to the pump stator. An oil tank provided with an oil cooler is provided in the motor casing.

In addition, provided is a turbo vacuum pump comprising a peripheral flow pump impeller and a spiral grooved pump impeller, wherein the normal rotation speed of the pump is set to 40000 r.p.m. or greater.

The other features, objects and advantages of this invention will be obvious from the following description with reference to the accompanying drawings.

DESCRIPTION OF THE PREFERRED EMBODIMENTS

Figure 1:
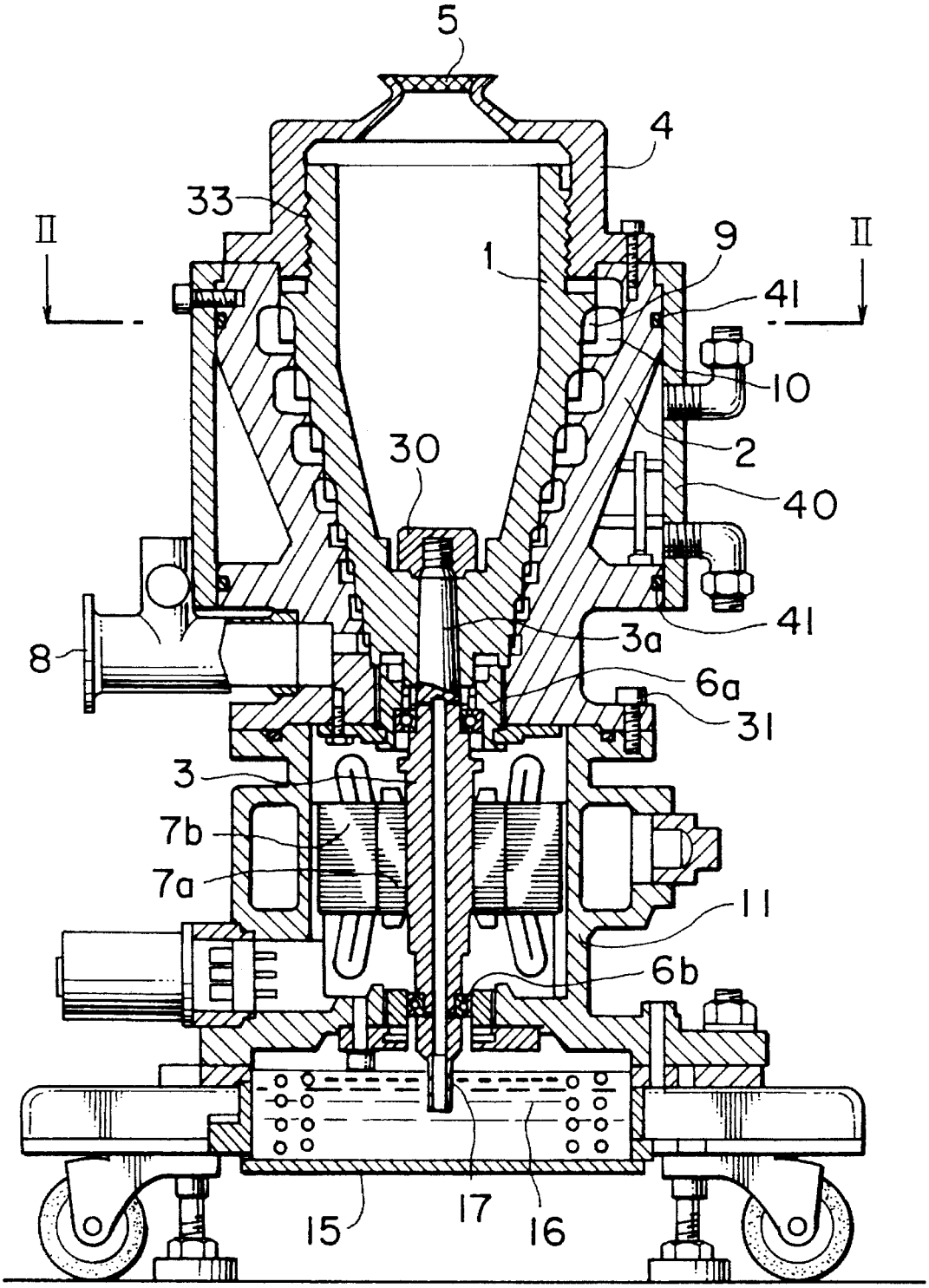
FIG. 1 is a vertical sectional view of an embodiment of a turbo vacuum pump according to the invention.

An embodiment of a turbo vacuum pump according to the invention is described with reference to the drawings. Referring to FIG. 1, a rotating shaft 3 is disposed vertically and is supported by rolling bearings *6a* and *6b* at a middle portion and a lower end portion. A high-frequency motor rotor *7a* is press-fit between the bearings. A pump rotor (hereinafter referred as a rotor) 1 is press-fit on an upper portion or overhang portion *3a* of the rotating shaft 3 and fixed by a bolt 30. A pump stator (hereinafter referred as a stator) 2 is placed coaxially with the rotor 1 with a clearance. A cylindrical suction casing 4 having an air suction port 5 of the pump provided with a filter is removably and airtightly attached to an upper portion of the stator 2. The stator 2 has an air discharge port 8 at a lower portion thereof. The rotor 1, stator 2, and suction casing 4 make up a pump section of the turbo vacuum pump.

In an outer periphery of the stator 2, a cooling jacket is formed for cooling a flow passage 10 of the turbo vacuum pump. That is, the cooling jacket is provided by forming the outer shape of the stator into a funnel, and attaching a side plate 40 to the outer periphery of the stator through O rings 41. An inside of the rotor 1 is bored to decrease an inertial mass of the rotor to improve response.

Furthermore, a motor stator *7b* is held by a lower casing 11 so as to be opposed to a motor rotor *7a*. The lower casing 11 and stator 2 are removably connected with each other by bolts 31. In a portion of the lower casing 11 which corresponds to the motor stator 7b, a cooling passage or cooling jacket is formed for cooling the motor section.

A portion of the rotating shaft 3 which lies under the rolling bearing 6b projects into an oil tank 15 attached to a bottom of the lower casing 11. Lubricating oil 16 in the oil tank 15 is pumped up by a lift cone 17, which is a conical pipe formed in the lower end of the rotating shaft 3. In the present embodiment, a self-supply type structure is employed in which the lubricating oil pumped up passes through an axial hole in the rotating shaft 3 and is supplied to each bearing 6a, 6b from radial holes provided in bearing sections.

Figure 2:
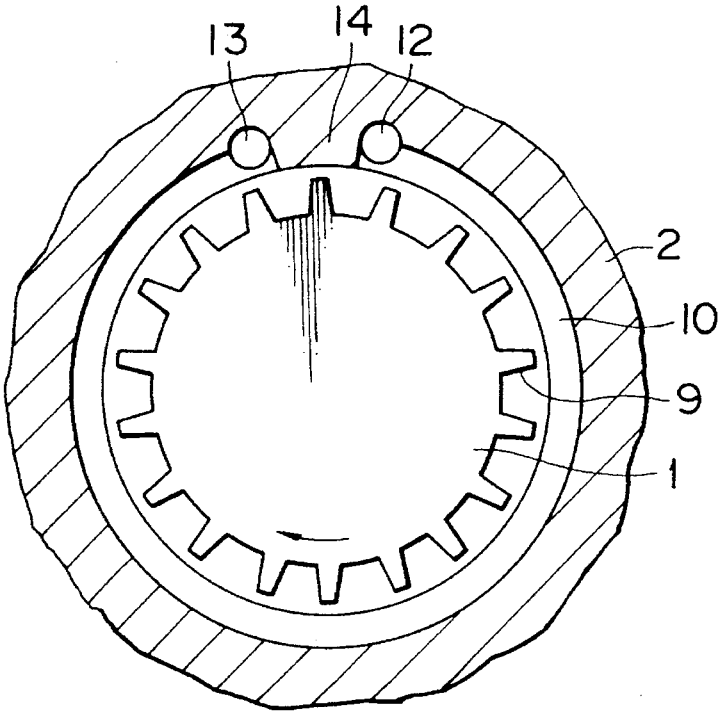
FIG. 2 is a cross-sectional view taken along line II—II in FIG. 1.

Referring to FIGS. 1 and 2, the pump section will be described in detail. A thread-like groove 33 is provided in the portion of the rotor 1 which is opposed to the suction casing 4, or in an outer peripheral surface of an upper end potion of the rotor to constitute a spiral grooved pump stage. An outer diameter of the rotor 1 which faces the stator 2, or of a portion downstream of the spiral grooved pump stage is formed to become stepwise smaller from an air suction port side to an air discharge port side thereof, namely, from the upper side to the lower side, forming steps. A peripheral flow blade 9 is provided at peripheral end of each of the steps to form a multistage peripheral flow pump. In response to the outer diameter of the rotor 1 becoming stepwise smaller axially, an inner diameter of the stator 2 becomes stepwise smaller. The flow passages 10 are formed on the inner surface of the stator 2 to oppose to each peripheral flow blade 9 of the rotor 1. In each of the flow passages 10, a partition 14 is provided between a suction opening 12 and a discharge opening 13 as shown in FIG. 2. The suction opening 12 is communicated with an upstream flow passage 10 and the discharge opening 13 is communicated with a downstream flow passage 10. A corrosion-resistant plating is applied on the outer periphery of the rotor 1 and the inner periphery of the stator 2 to prevent them from being damaged even if they come in contact with each other.

Figure 3:
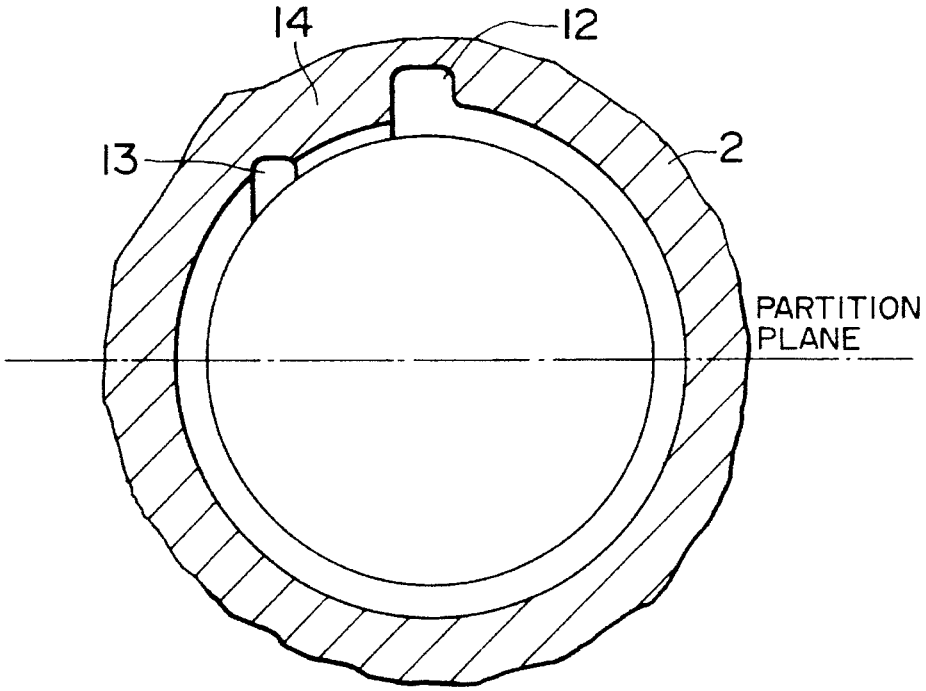
FIG. 3 is a transverse cross-sectional view of the stator of this invention.

Shapes of the suction opening 12 and the discharge opening 13 provided in the stator 2 are made to extend perpendicularly to a parting plane as shown in FIG. 3. With this structure, the stator 2 can be manufactured by normal casting whereas the stator 2 of the prior art shape could be manufactured only by fine casting. The manufacturing cost can be reduced to about 1/10.

An operation of the above described embodiment of the invention will be described hereinafter.

When the pump section is driven at high speed by the motor section comprising the motor rotor 7a and the motor stator 7b according to instructions from a controller (not shown), gas sucked from the air suction port 5 is sequentially compressed through the spiral grooved pump stage structured by the upper end of the rotor 1 and the suction casing 4 and the peripheral flow pump stage structured by the rotor 1 and stator 2, and discharged from the air discharge port 8. In each step of the peripheral flow pump stage, the gas flows in from the suction opening 12, and a peripheral velocity component is given to the gas by the peripheral flow blade 9 rotating at high speed. Then, the gas is radially discharged from the peripheral flow blade 9 by centrifugal force, decelerates within the flow passage 10 to recover pressure, and again enters the peripheral flow blade 9. The gas repeats the above described actions while passing through the flow passage 10 to obtain energy from the peripheral flow blade 9, and flows spirally in the flow passage 10, entering the next step from the discharge opening 13. By performing this action in a plurality of steps, a high compression ratio can be obtained and, consequently, it is also possible to directly discharge the gas into the atmosphere.

Since the spiral grooved pump stage having a cylindrical form and the stepped peripheral flow pump stage formed so that its diameter becomes stepwise smaller toward downstream are combined with each other, the rotor 1 can be drawn out in one direction, and the rotor 1 can be formed as one unit. The inner diameter of the stator is also made stepwise smaller in conformity with the rotor diameter, so that the stator can be formed as one unit. In addition, since the rotor and stator both can be withdrawn and inserted axially for disassembly and assembly, workability is improved.

Figure 4:
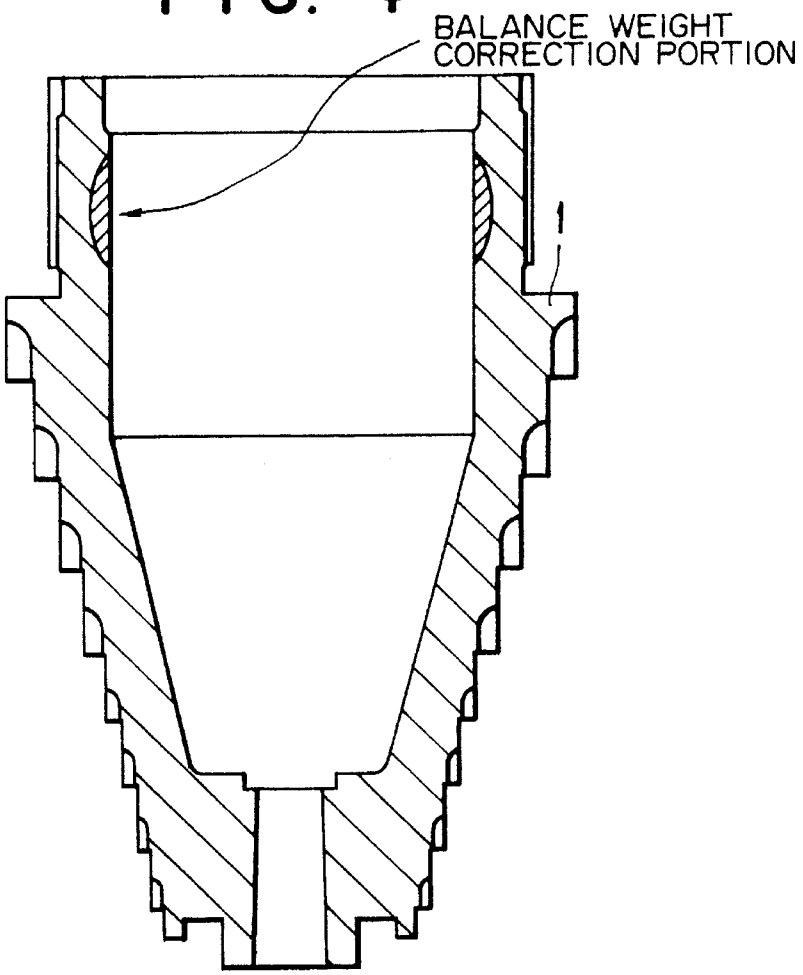
FIG. 4 is a longitudinal sectional view of a rotor of the invention.

Another embodiment of the rotor according to the invention is shown in FIG. 4. The rotor shown in FIG. 4 includes a balance weight correction portion provided on the internal surface of the rotor for correcting imbalance in rotation of the rotor or the rotor with the rotating shaft. This is different from the above described rotor. Since the turbo vacuum pump is run at high speed by a high-frequency motor, it is important to decrease the imbalance in rotation. Particularly, in a compact vacuum pump having a rotor whose maximum outer diameter is about 150 mm, the peripheral velocity is close to the speed of sound and the rotating speed of the rotating shaft becomes 40,000 rpm or higher, which requires a structure enabling easy balancing. A balancing position shown in FIG. 4 does not harm the pump performance and provides an advantage in which a mass to be added or removed for balancing can be a small amount since the balance correction is effect at a large diameter portion.

Figure 5:
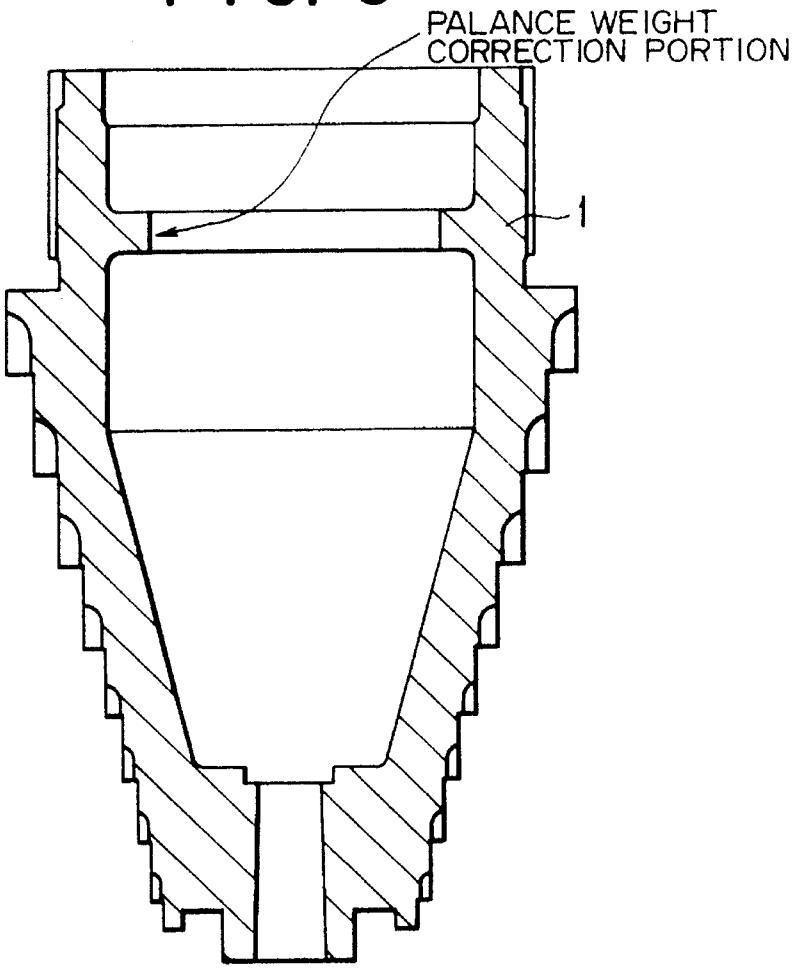
FIG. 5 is a longitudinal sectional view of another rotator of the invention.

FIG. 5 shows a variation of the rotor shown in FIG. 4, in which a ring-shaped projection is provided in the inner surface of the rotor 1 as a balance weight correction portion. This increases workability when balancing is made by abrasion using a grinder or the like.

Figure 6:
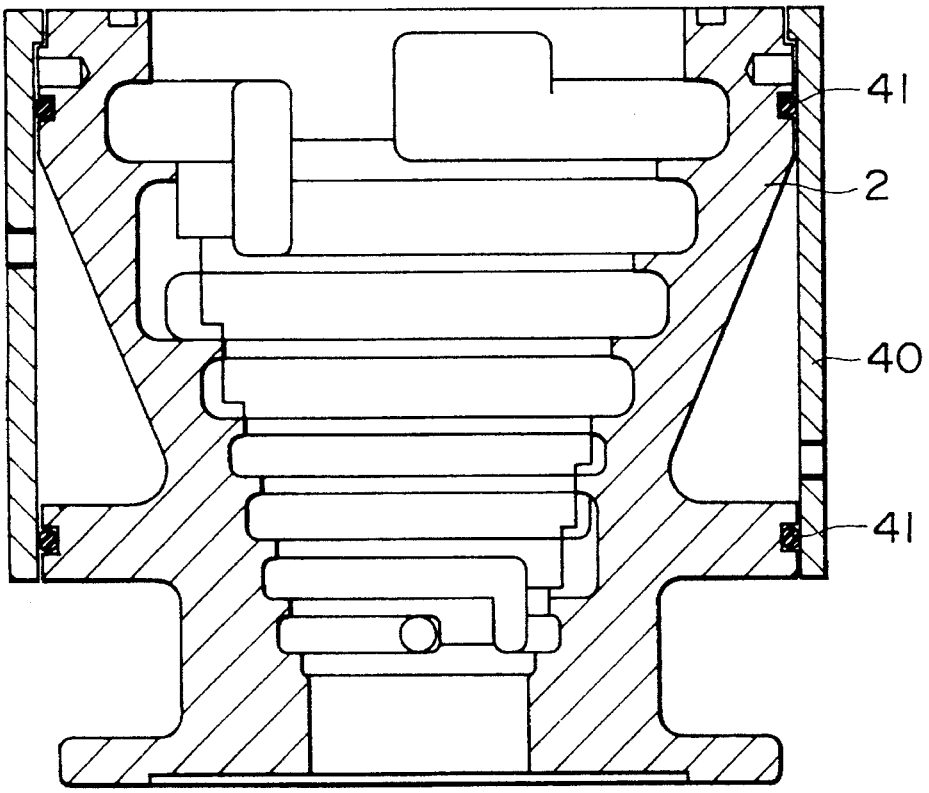
FIG. 6 is a longitudinal sectional view of a stator of the invention.

FIG. 6 shows the stator 2. The inner periphery of the stator 2 is stepped so as to provide a diameter which becomes stepwise smaller from the air suction port side to the air discharge port side and forms a total of eight pump steps. The suction openings 12 and the discharge openings 13 are provided at different peripheral positions at every step. This prevents action of an undesired eccentric force.

Figure 7:
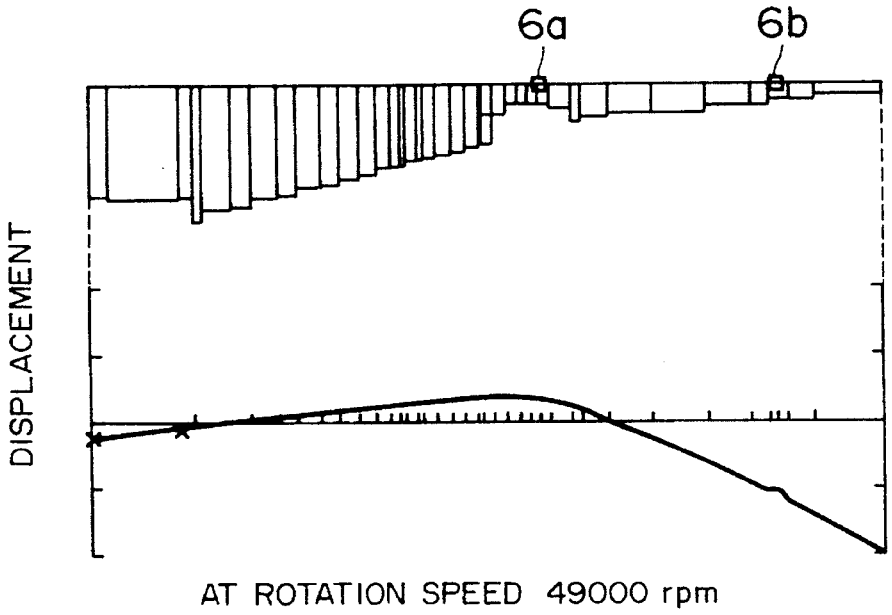
FIG. 7 is a view showing a result of a vibration analysis.

FIG. 7 shows a result of a calculation of the vibration mode when the rotor and rotating shaft are supported by two rolling bearings 6a, 6b. The upper part of the figure is an element division diagram when the rotating system of the rotor and the rotating shaft is replaced by equivalent disks, and the lower part of the figure is a mode chart made by plotting the displacements at the corresponding positions. In this embodiment, bending rigidity of the rotating shaft in the vicinity of the bearing 6a is made lower than that of the remainder of the rotating shaft. Therefore, displacement in the rotor section becomes small, even during operation in which a bending mode occurs. This prevents phenomena such as touching or seizing between the rotor and stator. Conversely, a clearance between the rotor and the stator can be made small, thereby increasing pump efficiency.

Figure 8:
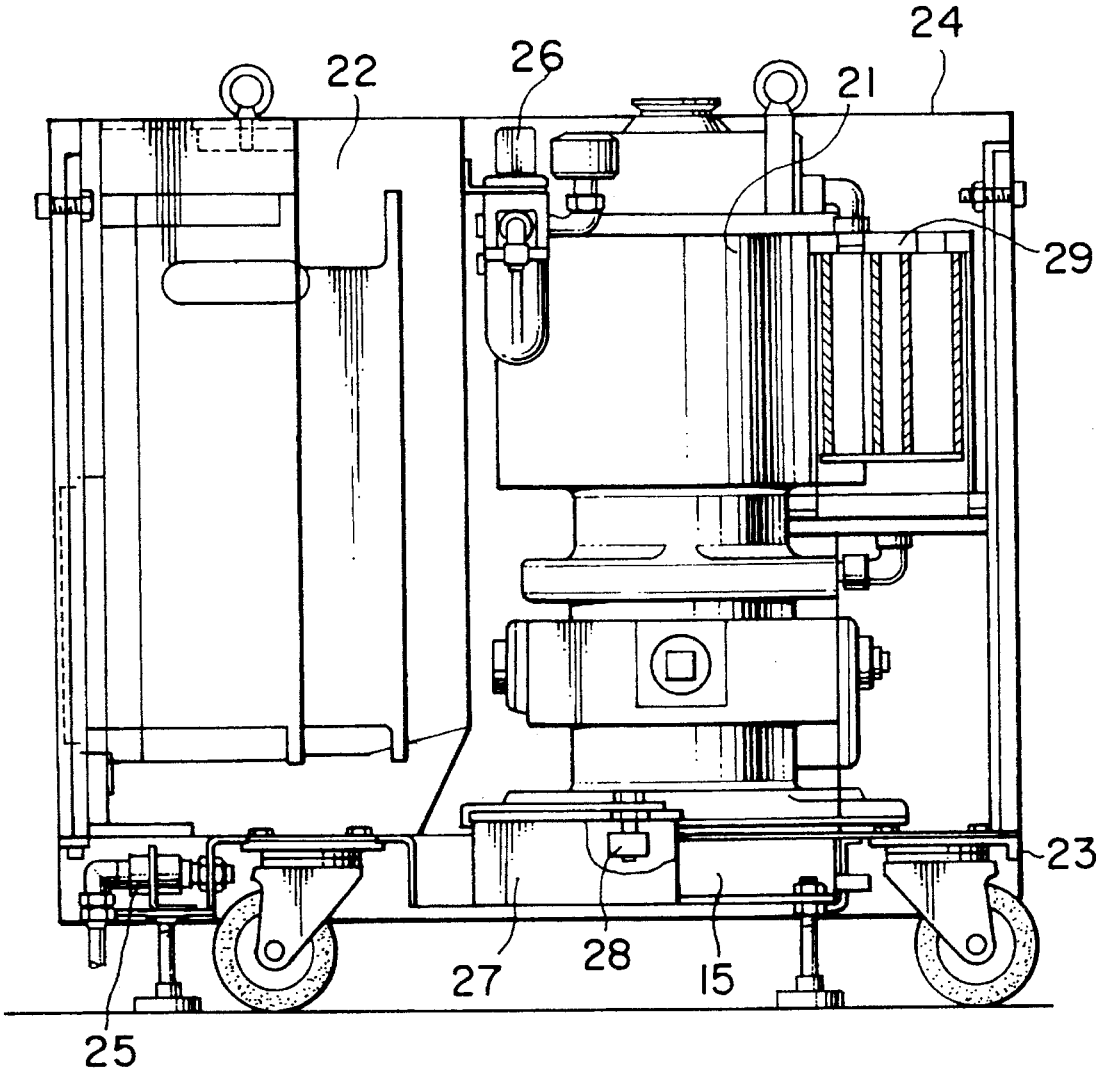
FIG. 8 is a vertical sectional view of a package type vacuum air discharge apparatus in which the embodiment shown in FIG. 1 is incorporated.

FIG. 8 shows an embodiment of an apparatus incorporating the turbo vacuum pump of the invention, in which a turbo vacuum pump 21, a pump controller 22 including an inverter power supply panel, and other auxiliary equipment are installed on a frame 23 and covered with a case 24, thereby providing a single package. Owing to the structure, the user need not do wiring work between the turbo vacuum pump 21 and pump controller 22 and, since the pump can be promptly started up by connecting only utilities such as power supply, water supply and drain, and shaft sealing gas, the rise time of the pump at the user site can be shortened. Furthermore, a constant flow valve 25 is provided in the water supply line so that water to the turbo vacuum pump can be stably supplied even if the water pressure varies. A regulator 26 is provided in the shaft sealing gas supply line to ensure stable supply to the turbo vacuum pump even if the gas pressure varies. A sub oil tank 27 is connected to the oil tank 15 to allow an appropriate amount of oil for the pump to be adjusted by the sub oil tank 27, and any decrease in the amount of oil is detected in advance by an oil level detector 28 to prevent a shortage of oil or the like. In addition, an oil mist collector 29 is provided in the lower casing 11. Oil mist contained in the shaft sealing gas flowing from the lower casing 11 is trapped by the oil mist collector 29 and, thereafter, it is separated into an oil component and a gas. The oil component is returned to the oil tank 15 and the gas is discharged from the air discharge port 8 along with the gas taken in from the air suction port 5. Accordingly, the exhaust gas becomes clean and a shortage of lubricating oil can be prevented.

According to the present invention, the peripheral flow impeller is formed in a stepped shape. Therefore, the stator can be formed as one unit whereas it could conventionally be embodied only in a complex shape dividable in two halves and can be formed by normal casting instead of the fine casting. The manufacturing cost of the stator can be reduced to about 1/10 of the conventional one. In addition, both the rotor and the stator can be formed as one unit respectively, so that dimention control becomes easy and assembly time is reduced to about half the time needed in the prior art because the rotor and the stator can be withdrawn or inserted axially for disassembly and assembly.

What is claimed is:

1. A turbo vacuum pump for compressing a low-pressure gas to discharge the compressed gas into atmosphere, said turbo vacuum pump comprising a rotating shaft supported for rotation by bearings, a pump rotor mounted on said rotating shaft, a motor rotor mounted on said rotating shaft, a pump casing in which an air suction port is formed, a pump stator attached to said pump casing and having an air discharge port and a cavity therein, and a motor casing attached to said pump stator for holding said motor stator, wherein said pump rotor is integrally formed with a spiral grooved pump stage on an air suction port side thereof and a peripheral flow pump stage downstream from said spiral grooved pump stage, the diameter of said peripheral flow pump stage becoming stepwise smaller downstream, and said pump stator has an inner diameter which becomes stepwise smaller downstream in accordance with the outer diameter of said peripheral flow pump stage so as to form a predetermined clearance in relation to said pump, and wherein cooling passages are respectively formed over the outer peripheries of said pump stator and said motor casing.

2. A turbo vacuum pump for compressing a low-pressure gas to discharge the compressed gas into atmosphere, said turbo vacuum pump comprising a casing having an air suction port, a pump stator attached to said casing and having an air discharge port and a cavity, a pump rotor having an outer periphery surface disposed opposite to an internal periphery surface of said pump stator, and a rotating shaft having said pump rotor attached to one end thereof and supported for rotating by bearings, wherein said pump rotor is formed as one unit, and has a cylindrical spiral grooved pump stage on an air suction port side thereof and a peripheral flow pump stage downstream of said spiral grooved pump stage, the diameter of said peripheral flow pump stage becoming stepwise smaller downstream, the inner diameter of said pump stator opposed to said peripheral flow pump stage of said pump rotor stepwise varies according to the outer diameter of said pump rotor so as to form a predetermined clearance therebetween, a cooling jacket through which a coolant circulates is formed on an outer periphery of said pump stator, said casing is disposed opposite to said pump rotor so as to form a predetermined clearance with the spiral grooved pump stage of said pump rotor, a motor rotor for driving said pump rotor is attached to the other end of said rotating shaft opposite to the end to which said pump rotor is attached, a motor stator is disposed opposite to said motor rotor, a motor casing is attached to said pump stator, said motor casing holding said motor stator and having on an outer periphery thereof a cooling passage through which a coolant circulates, and an oil tank provided in said motor casing.

3. A turbo vacuum pump according to claim 1, wherein a power supply panel for driving a motor comprising said motor stator and said motor rotor is provided, said power supply panel being contained in a housing in which the turbo vacuum pump is contained to provide a single structure.

4. A turbo vacuum pump according to claim 2, wherein said bearings supporting said rotating shaft comprise a first rolling bearing disposed in a vicinity of a portion of said rotating shaft to which said pump rotor is attached, and a second rolling bearing disposed in a vicinity of the opposite end to the portion of said rotating shaft to which said pump rotor is attached, and said motor rotor is disposed between said first rolling bearing and said second rolling bearing.

5. A turbo vacuum pump according to claim 4, wherein bending rigidity of said rotating shaft in a vicinity of said first rolling bearing for said rotating shaft is made lower than that of the remainder of said rotating shaft.

6. A turbo vacuum pump according to claim 1, wherein said turbo vacuum pump is a vertical type pump in which said rotating shaft is vertically disposed.

7. A turbo vacuum pump for compressing a low-pressure gas to discharge the compressed gas into atmosphere, said turbo vacuum pump comprising a rotating shaft supported for rotation by bearings, a pump rotor mounted on said rotating shaft, a motor rotor mounted on said rotating shaft, a pump casing in which an air suction port is formed, a pump stator attached to said pump casing and having an air discharge port and a cavity therein, and a motor casing attached to said pump stator for holding said motor stator, wherein said pump rotor is integrally formed with a spiral grooved pump stage on an air suction port side thereof and a peripheral flow pump stage downstream from said spiral grooved pump stage, the diameter of said peripheral flow pump stage becoming stepwise smaller downstream, and said pump stator has an inner diameter which becomes stepwise smaller downstream in accordance with the outer diameter of said peripheral flow pump stage so as to form a predetermined clearance in relation to said pump rotor, and wherein a balance weight correction portion is formed in the cavity of said pump rotor.

8. A turbo vacuum pump for compressing a low-pressure gas to discharge the compressed gas into atmosphere, said turbo vacuum pump comprising a rotating shaft supported for rotation by bearings, a pump rotor mounted on said rotating shaft, a motor rotor mounted on said rotating shaft, a pump casing in which an air suction port is formed, a pump stator attached to said pump casing and having an air discharge port and a cavity therein, and a motor casing attached to said pump stator for holding said motor stator, wherein said pump rotor is integrally formed with a spiral grooved pump stage on an air suction port side thereof and a peripheral flow pump stage downstream from said spiral grooved pump stage, the diameter of said peripheral flow pump stage becoming stepwise smaller downstream, and said pump stator has an inner diameter which becomes stepwise smaller downstream in accordance with the outer diameter of said peripheral flow pump stage so as to form a predetermined clearance in relation to said pump rotor, and wherein a corrosion resistant plating is applied on an outer periphery surface of said pump rotor and an inner periphery surface of said pump stator.

9. A turbo vacuum pump according to claim 1, wherein said pump stator is connected to the motor stator at a peripheral flow pump stage side thereof.

10. A turbo vacuum pump according to claim 1, wherein said rotor comprises a peripheral flow pump impeller and a spiral grooved pump impeller which are integrally connected.

11. A turbo vacuum pump according to claim 1, wherein said pump stator is formed as a funnel.

12. A turbo vacuum pump according to claim 2, wherein said air suction port is provided in a suction casing removably and airtightly attached to said pump stator.

13. A turbo vacuum pump according to claim 1, wherein said air suction port is provided with a filter.

* * * * *